US006058941A

United States Patent [19]

Denebeim

[11] Patent Number: 6,058,941

[45] Date of Patent: May 9, 2000

[54] METHOD OF TAPING AND CUTTING HAIR

[76] Inventor: Sabrina R. Denebeim, 260 Avila St., San Francisco, Calif. 94123

[21] Appl. No.: 09/336,647

[22] Filed: Jun. 18, 1999

[51] Int. Cl.[7] ..... A45D 24/00

[52] U.S. Cl. ..... 132/200

[58] Field of Search ..... 132/200, 213, 132/213.1, 214, 210

[56] References Cited

U.S. PATENT DOCUMENTS

| | | | |
|---|---|---|---|
| 2,581,704 | 1/1952 | Reno | 132/200 |
| 2,919,702 | 1/1960 | Olivo | 132/200 |
| 3,464,424 | 9/1969 | Buzzelli | 132/210 |
| 4,414,991 | 11/1983 | Marcotte | 132/214 |
| 5,427,122 | 6/1995 | Hamilton | 132/214 |
| 5,832,937 | 11/1998 | Fujikawa | 132/200 |
| 5,927,292 | 7/1999 | Chicoine | 132/200 |
| 5,954,063 | 9/1999 | Pomaro | 132/213 |

*Primary Examiner*—Todd E. Manahan
*Attorney, Agent, or Firm*—Majestic, Parsons, Siebert & Hsue P.C.

[57] ABSTRACT

A method of cutting hair is provided. First, a strip of adhesive tape is attached onto a person's hair. Second, the hair below an edge of the strip of adhesive tape is removed by cutting along the edge. And third, the strip tape is detached. The present inventive method of cutting hair may be used to remove hair that is either dry or damp.

43 Claims, 7 Drawing Sheets

METHOD OF TAPING AND CUTTING HAIR

FIELD OF THE INVENTION

The present invention relates to methods of cutting hair.

BACKGROUND OF THE INVENTION

Barbers and hairstylists have been responsible for cutting hair of many adults and children. One reason is that they are typically well-trained professionals and thus earn the trust of customers, at least before the first haircut, that they can provide a satisfactory haircut. In addition, depending on the type of haircut, conventional haircutting methods generally require numerous steps and are very involved. Thus, these methods require the expertise of professional barbers and hairstylists. Although, for example, parents would like to provide haircut for their own children at home to save time and money, they do not do so for the following reasons: [1] the parents are not trained to cut hair, [2] conventional methods of cutting hair are too difficult to execute, [3] or both.

Furthermore, children typically have low attention span, and as a result, they cannot remain still throughout their haircut. Additionally, when a child is unfamiliar with the barber or hairstylist, the child tends to resist any hair cutting effort. Because of their restlessness and resistance, cutting children hair is typically more difficult and generally requires more time than cutting adult hair.

Moreover, during each haircut, the barber or hairstylist uses his or her fingers to hold each customer's hair so as to provide a guide for removing the undesirable hair by cutting along the fingers. Throughout the working day, these same fingers make contact with various customers'hairs and thus such contact is unsanitary.

SUMMARY OF THE INVENTION

The present invention recognized and was achieved to overcome the problems as stated above. Therefore, it is a general object of the present invention to provide a method of cutting hair that is simple and requires no professional training to perform.

It is another object of the present invention to provide a method of cutting hair that is more sanitary than conventional methods of cutting hair.

It is another object to the present invention to provide a method of cutting hair that may be performed at home.

According to the method of cutting hair of the present invention, first, a strip of adhesive tape is attached onto a person's hair. Second, the hair below an edge of the strip of adhesive tape is removed. And third, the strip tape is detached. The present inventive method of cutting hair may be used to remove hair that is either dry or damp.

BRIEF DESCRIPTION OF THE DRAWINGS

Other objects and features of the present invention and many of the attendant advantages of the present invention will be readily appreciated and become better understood by reference to the detailed description when considered in connection with the accompany drawings in which like reference numerals designate like parts throughout the figures thereof and wherein.

DETAILED DESCRIPTION OF THE PREFERRED EMBODIMENTS

Figure 1:
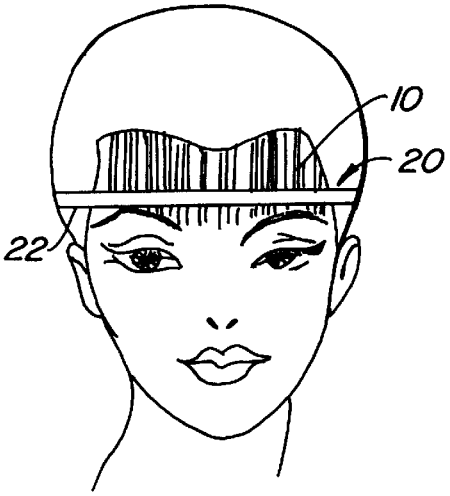
FIG. 1 illustrates a first embodiment of cutting hair according to the present invention.

FIG. 1 shows the first embodiment of the present inventive method of cutting hair resulting in a "blunt bangs" haircut. First, bangs 10 are combed. Second, a strip of adhesive tape 20 such as hair tape is attached onto the bangs 10. As a result, the strip of adhesive tape 20 extends from one side of the head towards the other and is substantially parallel to the ground. Depending on the desirable length of hair remaining after the haircut, the strip of adhesive tape 20 is preferably positioned slightly above that desirable length. Third, the bangs 10 are removed by cutting along an edge 22 of the strip of adhesive tape 20. And fourth, the strip of adhesive tape 20 is detached.

Figure 2:
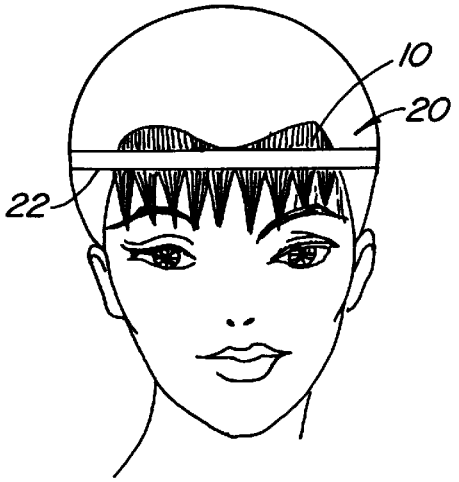
FIG. 2 shows a second embodiment of cutting hair according to the present invention.

FIG. 2 shows the second embodiment of the present inventive method of cutting hair resulting in a "wispy bangs" haircut. In the wispy bangs embodiment, its first four steps are the same as the first four steps of the blunt bangs embodiment discussed above. After the fourth step, fifth, the strip of adhesive tape 20 is reattached onto the bangs 10 and above a hair line (not shown) of the bangs 10, preferably about an inch above the hair line. Such hair line indicates the desirable length which remains after the third step. In addition, instead of reusing the strip of adhesive tape 20, another piece of adhesive tape may also be used. Again, the strip of adhesive tape 20 extends from one side of the head towards the other and is substantially parallel to the ground. Sixth, the bangs 10 are repeatedly cut from the hair line towards the edge 22 such that the resulting bangs have a sawtooth shape as illustrated by FIG. 2. And seventh, the strip of adhesive tape 20 is detached.

Figure 3:
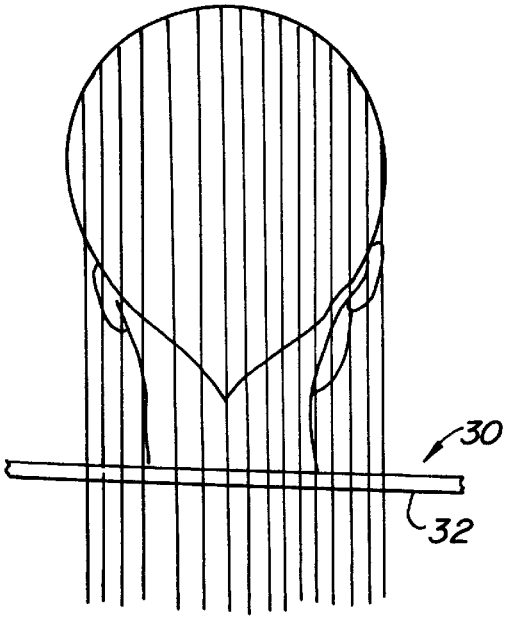
FIG. 3 illustrates a third embodiment of cutting hair according to the present invention.

FIG. 3 illustrates the third embodiment of the present inventive method of cutting hair resulting in a "one length" haircut. First, the hair is parted in the middle. That is, the hair is parted with respect to a reference line that [a] extends from the forehead (not shown) towards the back of the head and [b] is equally distant between the ears. Second, the hair is downwardly combed such that the combed hair falls onto the back of the body (not shown). Third, a strip of adhesive tape 30 is attached onto the hair covering the back of the body and the back of the body. As a result, the strip of adhesive tape 30 is substantially parallel to the ground. Again, depending on the desirable length of hair remaining after the haircut, the strip of adhesive tape 30 is preferably positioned slightly above that desirable length. Fourth, the hair is removed by cutting along the edge 32 of the strip of adhesive tape 30. And fifth, the strip of adhesive tape 30 is detached.

In addition, the one length embodiment may also be combined with either the blunt or wispy bangs embodiment. If such combination is desirable, the steps of either the blunt or wispy bangs embodiment should be performed prior to the steps of the one length embodiment.

Figure 4:
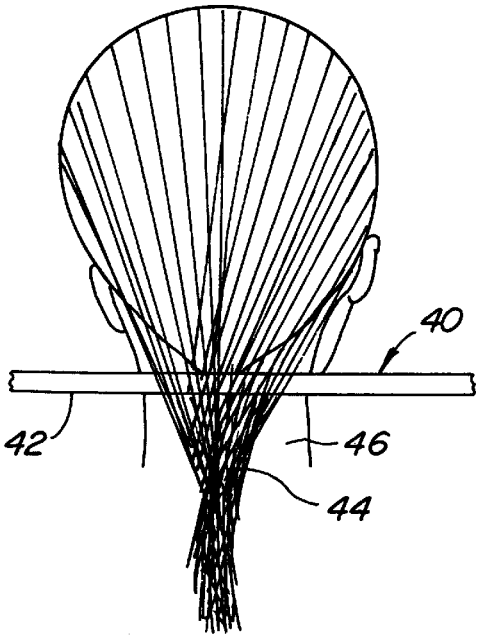
FIG. 4 shows a fourth embodiment of cutting hair according to the present invention.

FIG. 4 shows the fourth embodiment of the present inventive method of cutting hair resulting in an "A-Line Bob I" haircut. First, the hair is parted in the middle. Second, the hair is downwardly combed. Third, with the hair, a ponytail 44 is formed behind the head. Preferably, the ponytail 44 a flat ponytail. Fourth, a strip of adhesive tape 40 is attached onto the ponytail 44 and a person's neck 46 such that the strip of adhesive tape 40 is substantially parallel to the ground. Again, depending on the desirable length of hair remaining after the haircut, the strip of adhesive tape 40 is preferably positioned slightly above that desirable length. Fifth, the hair is removed by cutting along the edge 42 of the strip of adhesive tape 40. And sixth, the strip of adhesive tape 40 is detached.

In addition, the A-Line Bob I embodiment may also be combined with either the blunt or wispy bangs embodiment. If such combination is desirable, the steps of either the blunt or wispy bangs embodiment should be performed prior to the steps of the A-Line Bob I embodiment.

Figure 5A:
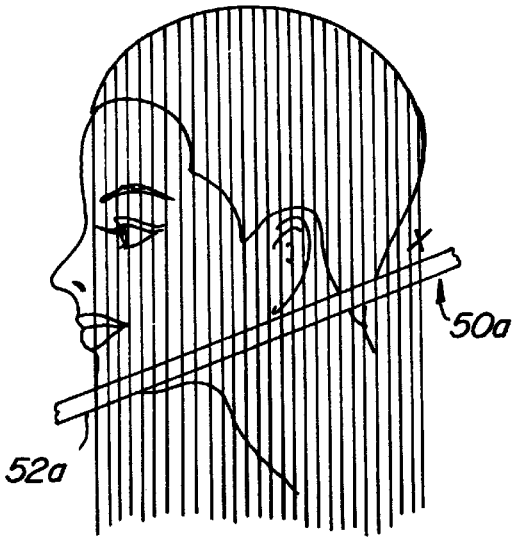
FIGS. 5*a* and 5*b* illustrate a fifth embodiment of cutting hair according to the present invention.
Figure 5B:
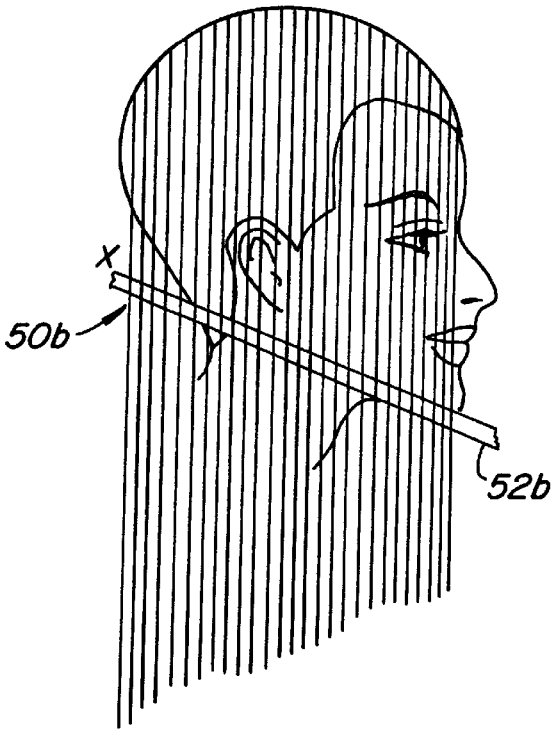

FIGS. 5*a* and 5*b* illustrate the fifth embodiment of the present inventive method of cutting hair resulting in an "A-Line Bob II" haircut. First, the hair is parted in the middle. Second, the hair is downwardly combed. Third, with respect to the combed hair on a first side of the head of FIG. 5*a*, a first strip of adhesive tape 50*a* is attached onto [a] the hair, [b] a first side of the chin, and [c] the back of the head indicated by "X". Fourth, with respect to the combed hair on a second side of the head of FIG. 5*b*, a second strip of adhesive tape 50*b* is attached onto [a] the hair, [b] a second side of the chin, and [c] the back of the head such that the first strip of adhesive tape 50*a* and the second strip of adhesive tape 50*b* meet at X. Note that both the first and second strips of adhesive tape 50*a* and 50*b* extend upwardly from the chin to the back of the head. Alternatively, both the first and second strips of adhesive tape 50*a* and 50*b* may also be attached so that they extend upwardly from the neck to the back of the head. Fifth, the hair is removed by cutting along edges 52*a* and 52*b* of the first and second strips of adhesive tape 50*a* and 50*b* respectively. And sixth, the first and second strips of adhesive tape 50*a* and 50*b* are detached.

In addition, the A-Line Bob II embodiment may also be combined with either the blunt or wispy bangs embodiment. If such combination is desirable, the steps of either the blunt or wispy bangs embodiment should be performed prior to the steps of the A-Line Bob II embodiment.

Figure 6:
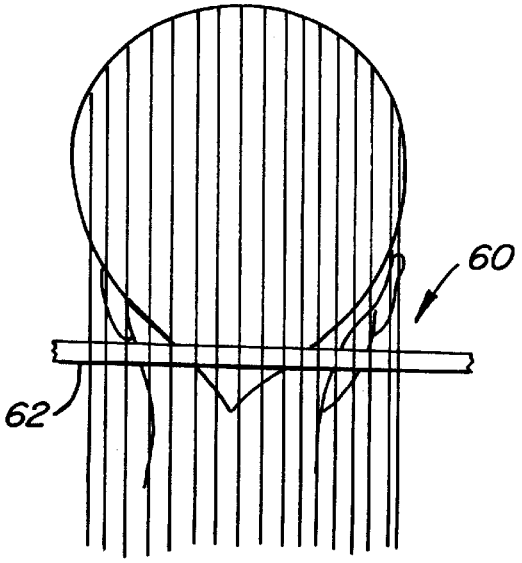
FIG. 6 shows a sixth embodiment of cutting hair according to the present invention.

FIG. 6 shows the sixth embodiment of the present inventive method of cutting hair resulting in a "Bob" haircut. First, the hair is parted in the middle. Second, the hair is downwardly combed. Third, a strip of adhesive tape 60 is attached onto the hair and around the neck to thereby form a collar that is substantially parallel to the ground. For a shorter desirable length, the strip of adhesive tape 60 may be attached onto a first side of the chin (not shown), the hair and a second side of the chin. Fourth, the hair is removed by cutting along an edge 62 the strip of adhesive tape 60. And fifth, the first strip of adhesive tape 60 is detached.

In addition, the Bob embodiment may also be combined with either the blunt or wispy bangs embodiment. If such combination is desirable, the steps of either the blunt or wispy bangs embodiment should be performed prior to the steps of the Bob embodiment.

Figure 7A:
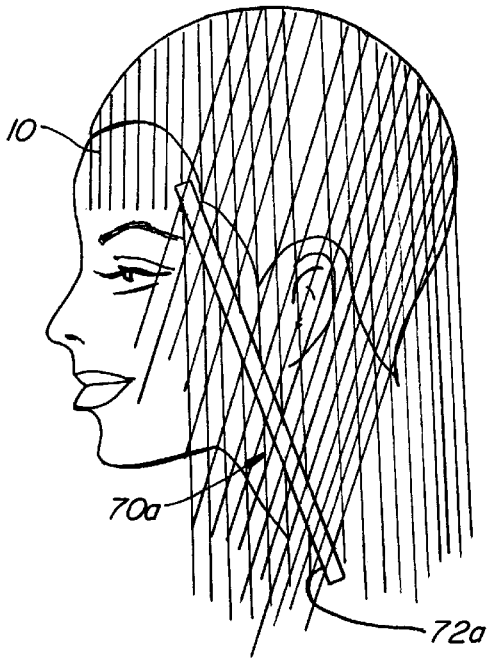
FIGS. 7*a*–7*c* illustrate a seventh embodiment of cutting hair according to the present invention.
Figure 7B:
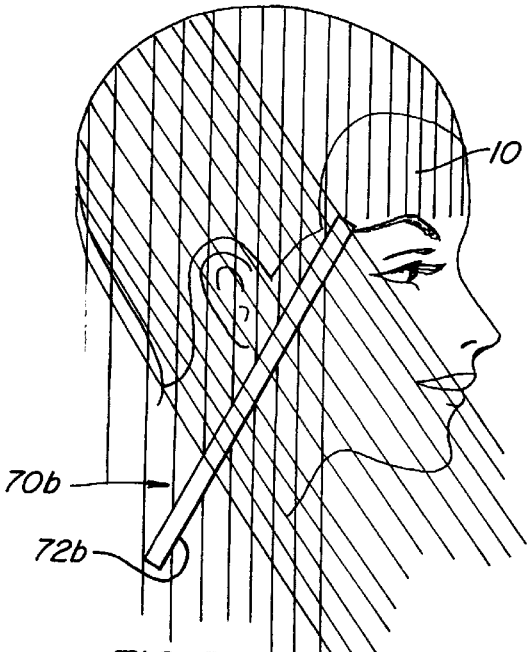
Figure 7C:
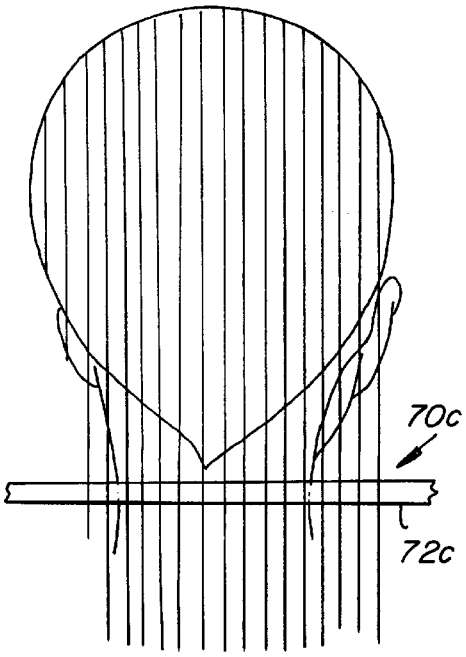

FIGS. 7*a*–7*c* illustrate the seventh embodiment of the present inventive method of cutting hair resulting in an "Angle" haircut. First, the hair is downwardly combed. Second, the hair on a first side of the head is combed forward and towards the face as illustrated by FIG. 7*a*. Third, a first strip of adhesive tape 70*a* is attached onto the forwardly combed hair and a first side of the neck such that it extends upwardly from the first side of the neck to a first corner where the bangs 10 meet the forwardly combed hair on the first side of the head. Fourth, the hair on a second side of the head is combed forward and towards the face as illustrated by FIG. 7*b*. Fifth, a second strip of adhesive tape 70*b* is attached onto the forwardly combed hair and a second side of the neck such that the second strip of adhesive tape 70*b* extends upwardly from the second side of the neck to a second corner where the bangs 10 meet the forwardly combed hair on the second side of the head. Sixth, the hair along edges 72*a* and 72*b* of the first and second strips of adhesive tape 70*a* and 70*b* respectively are removed or cut off. Seventh, both the first and second strips of adhesive tape 70*a* and 70*b* are detached. Eighth, the hair on the back of the head is downwardly combed as illustrated by FIG. 7*c*. Ninth, a third strip of adhesive tape 70*c* is attached onto the hair and the back of the neck. For a longer desirable length, third strip of adhesive tape 70*c* may be attached onto the hair and the back of the body. As a result, the third strip of adhesive tape is substantially parallel to the ground. Tenth, the hair is removed by cutting along an edge 72*c* of the third strip of adhesive tape 70*c*. And tenth, the third strip of adhesive tape 70*c* is detached.

In addition, the Angle embodiment may also be combined with either the blunt or wispy bangs embodiment. If such combination is desirable, the steps of either the blunt or wispy bangs embodiment should be performed prior to the steps of the Angle embodiment.

Figure 8A:
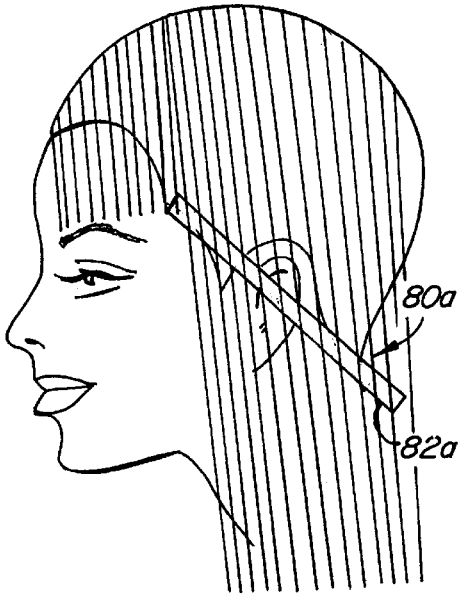
FIGS. 8*a*–8*c* show an eighth embodiment of cutting hair according to the present invention.
Figure 8B:
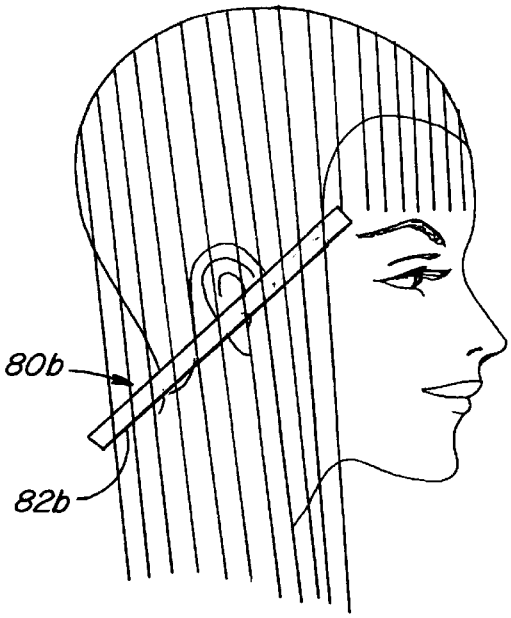
Figure 8C:
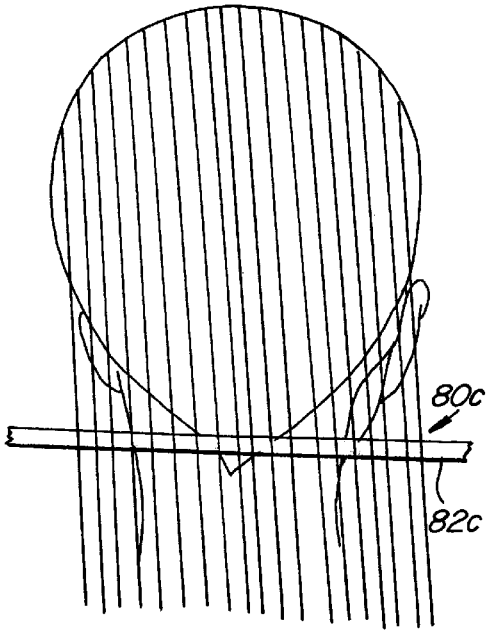

FIGS. 8*a*–8*c* shows the eighth embodiment of the present inventive method of cutting hair resulting in a "Bowl" haircut. For this embodiment, the steps of either the blunt or wispy bangs embodiment described above are first performed. Thereafter, the hair is parted in the middle. Thereafter, the hair on the first side of the head is combed downwardly as illustrated by FIG. 8*a*. Thereafter, a first strip of adhesive tape 80*a* is attached onto the hair such that it extends [1] downwardly from a first corner, where the bangs meet the combed hair on the first side of the head, to the back of the head and [2] across or above a first ear on the first side of the head. Thereafter, the hair is removed by cutting along an edge 82*a* of the first strip of adhesive tape 80*a*. Thereafter, the first strip of adhesive tape 80*a* is detached. Thereafter, the hair on a second side of the head is combed downwardly as illustrated by FIG. 8*b*. Thereafter, a second strip of adhesive tape 80*b* is attached onto the hair such that it extends [1] downwardly from a second corner, where the bangs meet the combed hair on the second side of the head, to the back of the head and [2] across or above a second ear on the second side of the head. Thereafter, the hair is removed by cutting along an edge 82*b* of the second strip of adhesive tape 80*b*. Thereafter, the second strip of adhesive tape 80*b* is detached. Thereafter, the hair on the back of the head is downwardly combed as illustrated by FIG. 8*c*. Thereafter, a third strip of adhesive tape 80*c* is attached onto the hair and the neck. For a shorter desirable length, the third strip of adhesive tape 80*c* is attached onto the hair covering the back of the head. As a result, the third strip of adhesive tape 80*c* is substantially parallel to the ground. Thereafter, the hair is removed along an edge 82*c* of the third strip of adhesive tape 80*c*. And finally, the third strip of adhesive tape 80*c* is detached.

Figure 9A:
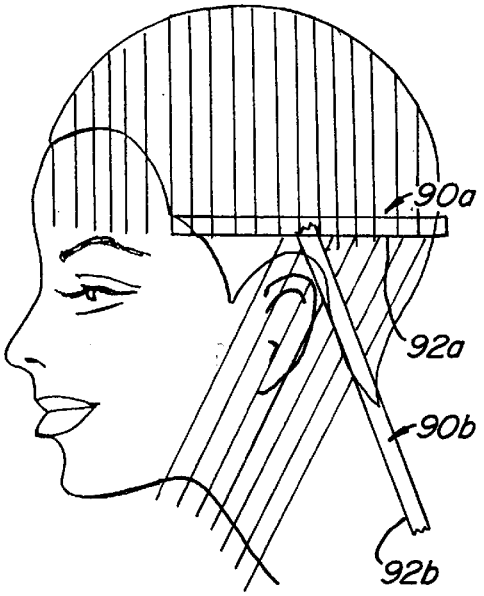
FIGS. 9*a*–9*c* illustrate a ninth embodiment of cutting hair according to the present invention.
Figure 9B:
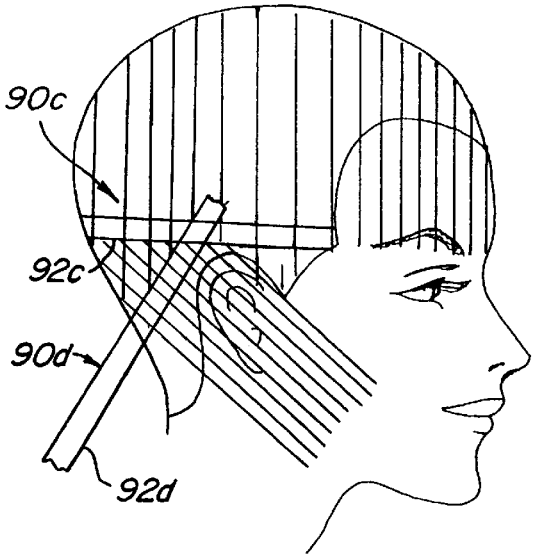
Figure 9C:
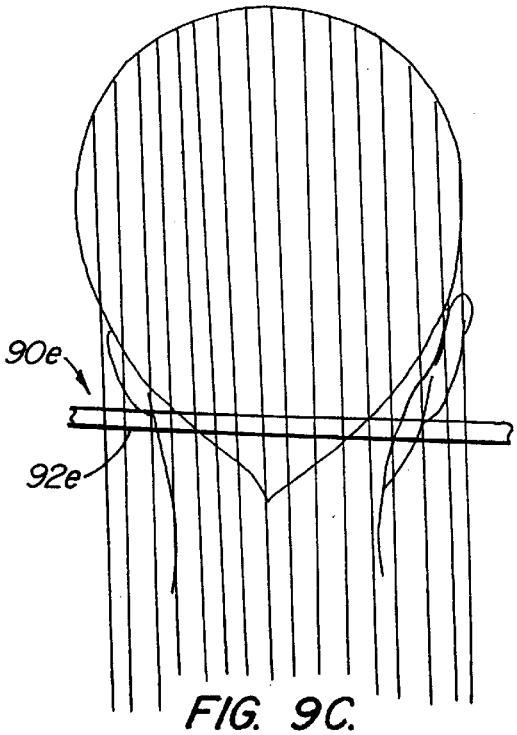

FIGS. 9*a*–9*c* illustrate the ninth embodiment of the present inventive method of cutting hair resulting in a "Short" haircut. For this embodiment, the steps of either the blunt or wispy bangs embodiment described above are first performed. Thereafter, the hair is parted in the middle. Thereafter, the hair is downwardly combed. Thereafter, a first strip of adhesive tape 90*a* is attached onto the hair on the first side of the head such that it extends [a] above the first ear and [b] horizontally from the face to the back of the head as illustrated by FIG. 9*a*. Thereafter, the hair is removed by cutting along an edge 92*a* of the first strip of adhesive tape 90*a* starting from an end of the first strip 90*a* on the face and ending at a first location on the head that is behind the first ear with respect to the face. Thereafter, the first strip of adhesive tape 90*a* is detached. Thereafter, the hair, which is on the first side of the head and is behind the first ear with respect to the face, is combed towards the face. Thereafter, a second strip of adhesive tape 90*b* is attached onto the hair such that it extends upwardly from a middle of the back of the neck to the first location. Thereafter, the hair is removed by cutting along an edge 92*b* of the second strip of adhesive tape 90*b*. Thereafter, the second strip of adhesive tape 90*b* is detached. Thereafter, a third strip of adhesive tape 90*c* is onto the hair on the second side of the head such that it extends [a] above the second ear and [b] horizontally from the face to the back of the head as illustrated by FIG. 9*b*. If a different length is desirable, the first and third strips of adhesive tape 90*a* and 90*c* are attached such that they extend [a] over the respective first and second ears and [b] horizontally from the face to the back of the head. Thereafter, the hair is removed by cutting along an edge 92*c* of the third strip of adhesive tape 90*c* starting from an end of the third strip 90*c* on the face and ending at a second location on the head that is behind the second ear with respect to the face. Thereafter, the third strip of adhesive tape 90*c* is detached. Thereafter, the hair, which is on the second side of the head and is behind the second ear with respect to the face, is combed towards the face. Thereafter, a fourth strip of adhesive tape 90*d* onto the hair such that it extends upwardly from the middle of the back of the neck to the second location. Thereafter, the hair is removed by cutting along an edge 92*d* of the fourth strip of adhesive tape 90*d*. Thereafter, the fourth strip of adhesive tape 90*d* is detached. Thereafter, the hair on the back of the head is combed downwardly as illustrated by FIG. 9*c*. Thereafter, a fifth strip of adhesive tape 90*e* is attached onto the hair covering the back of the neck and onto the neck. For a different desirable length, the fifth strip of adhesive tape 90*e* is attached onto the hair covering the back of head. As a result, the fifth strip of adhesive tape 90*e* is substantially parallel to the ground. Thereafter, the hair is removed along an edge 92*e* of the fifth strip of adhesive tape 90*e*. And finally, the fifth strip of adhesive tape 90*e* is detached.

Figure 10A:
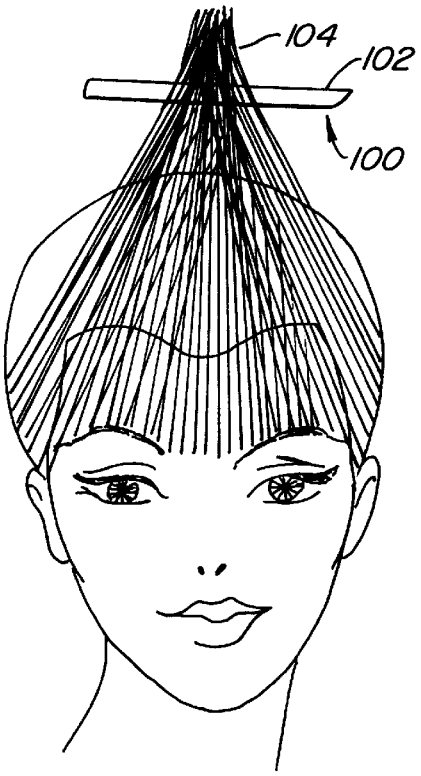
FIGS. 10*a*–10*d* show a tenth embodiment of cutting hair according to the present invention.
Figure 10B:
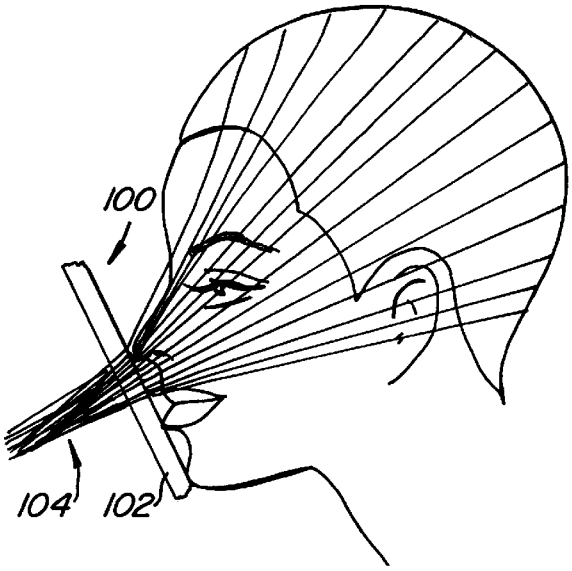
Figure 10C:
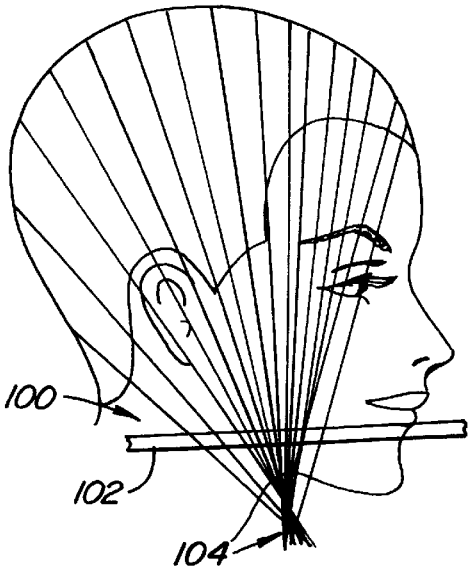
Figure 10D:
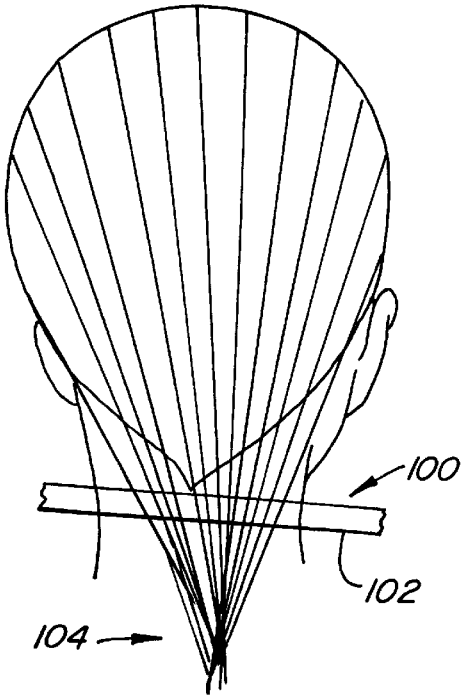
Figure 11A:
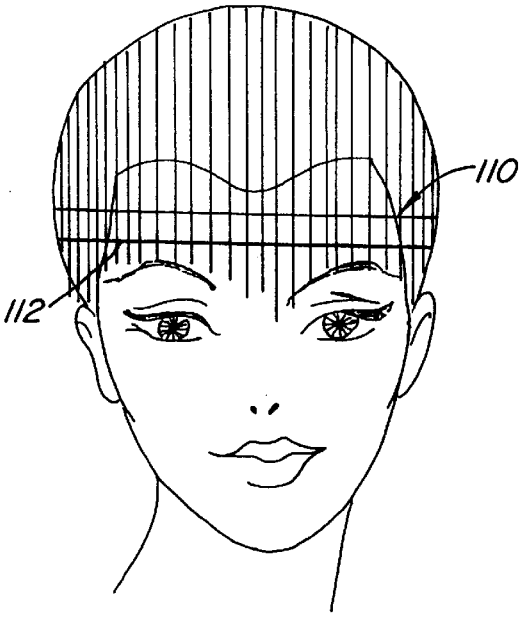
FIGS. 11*a*–11*d* illustrate an eleventh embodiment of cutting hair according to the present invention.
Figure 11B:
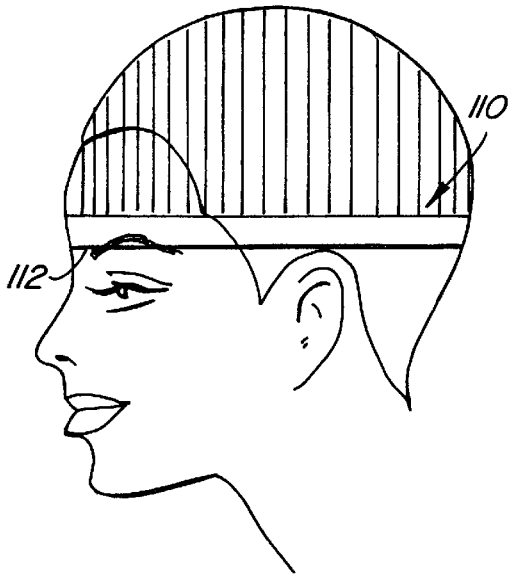
Figure 11C:
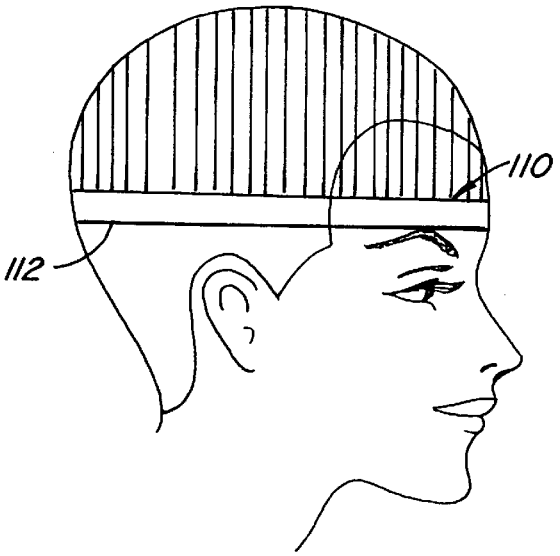
Figure 11D:
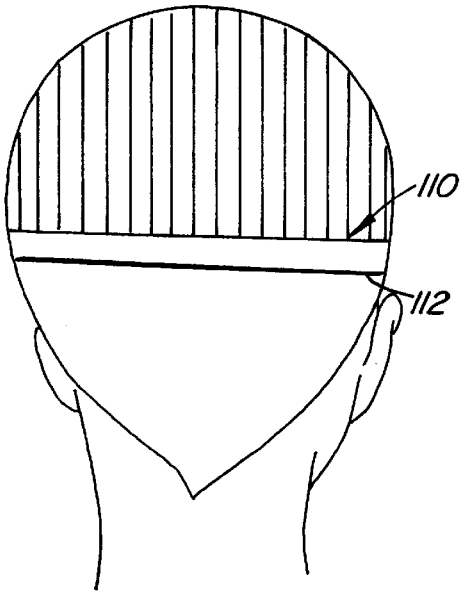

FIGS. 10*a*–10*d* show the tenth embodiment of the present inventive method of cutting hair resulting in a "Layers" haircut. First, the hair is parted in the middle. Second, the hair is combed downwardly. Third, a ponytail 104 is formed on either a left (FIG. 10*b*) or right (FIG. 10*c*) side of the head such that the ponytail 104 extends from that side of the head and is substantially parallel to the ground. In addition, the ponytail 104 may also be formed behind the head (FIG. 10*d*). Furthermore, the ponytail may also be formed above the head such that the ponytail 104 extends substantially vertically from the top of the head (FIG. 10*a*). Fourth, a strip of adhesive tape 100 is wrapped around the ponytail. Fifth, the hair is removed by cutting along an edge 102. And sixth, the strip of adhesive tape 100 is detached.

FIGS. 11*a*–11*d* show the eleventh embodiment of the present inventive method of cutting hair resulting in a "Bowl Buzz" haircut. First, the hair is combed downwardly. Second, a strip of adhesive tape 110 is attached onto the hair and around a person's head to thereby form a headband. Third, the hair is removed by [a] shaving off the hair that is below an edge 112 or [b] cutting along an edge 112. And fourth, the strip of adhesive tape 110 is detached.

The above embodiments of the present inventive method of cutting hair may be performed on hair that is wet or dry. Preferably, the hair is dampened with, for example, a spray detangler prior to performing the steps of each of the above embodiment.

As one can see from the above descriptions for various embodiments, the present inventive method is easy to perform and thus, for example, parents may use the present inventive method to provide their young children with a desired style of haircut in their own home at their convenience. In addition, a child, who is receiving a haircut from his or her parent, tends to cooperate during the haircut because the child is familiar with the parent. However, if the child does become restless or resist any further haircutting effort, the parent can stop and wait until such restlessness or resistance lessens before continuing on with the haircut because the adhesive tape will continue to hold the hair in place.

With the present invention has been described in conjunction with several alternative embodiments, these embodiments are offered by way of illustration rather than by way of limitation. Those skilled in the art will be enabled by this disclosure to make various modifications and alterations to the embodiments described without departing from the spirit and scope of the present invention. Accordingly, these modifications and alterations are deemed to lie within the spirit and scope of the present invention as specified by the appended claims.

What is claimed is:

1. A method of cutting hair which comprises:

a first step of attaching a first strip of adhesive tape onto the hair;

a second step of removing the hair along an edge of the first strip of adhesive tape; and a third step of detaching the first strip of adhesive tape.

2. The method of claim 1 further comprising a step of:

before the first step, downwardly combing bangs of the hair;

wherein the first step includes attaching the first strip of adhesive tape onto the bangs, the first strip of adhesive tape extending horizontally from a first side of a person's head to a second side of the head; and wherein the second step includes cutting the bangs along the edge.

3. The method of claim 2 further comprising steps of:

after the third step, re-attaching the first strip of adhesive tape onto the hair and above a hair line of the remaining bangs, the first strip of adhesive tape extending horizontally from the first side of the head to the second side of the head;

repeatedly cutting the bangs from the hair line towards the edge, wherein the resulting bangs have a sawtooth shape; and detaching the first strip of adhesive tape.

4. The method of claim 3 further comprising steps of:

after the step of detaching the first strip of adhesive tape, parting the hair with respect to a reference line that extends from a forehead of the head towards a back of the head and is equally distant between ears of the head;

downwardly combing the hair, the combed hair falling on a back of a person's body;

attaching a second strip of adhesive tape onto the hair and the back of the body, the second strip of adhesive tape substantially parallel to a ground;

cutting the hair along an edge of the second strip of adhesive tape; and detaching the second strip of adhesive tape.

5. The method of claim 3 further comprising steps of:

after the step of detaching the first strip of adhesive tape, parting the hair with respect to a reference line that extends from a forehead of the head towards a back of the head and is equally distant between ears of the head;

downwardly combing the hair;

forming a ponytail behind the head with the hair;

attaching a second strip of adhesive tape onto the ponytail and a person's neck, the second strip of adhesive tape substantially parallel to a ground;

cutting the hair of the ponytail along an edge of the second strip of adhesive tape; and detaching the second strip of adhesive tape.

6. The method of claim 3 further comprising steps of:

after the step of detaching the first strip of adhesive tape, parting the hair with respect to a reference line that extends from a forehead of the head towards a back of the head and is equally distant between ears of the head;

downwardly combing the hair;

attaching a second strip of adhesive tape onto the hair, a first side of a person's neck and the back of the head, the second strip of adhesive tape extending upwardly from the first side of the neck to the back of the head;

attaching a third strip of adhesive tape onto the hair, a second side of the neck and the back of the head, the third strip of adhesive tape extending upwardly from the second side of the neck to the back of the head;

wherein the third strip and the second strip of adhesive tape meet at the back of the neck;

removing the hair below an edge of the third strip of adhesive tape;

removing the hair below an edge of the second strip of adhesive tape;

detaching the second strip of adhesive tape; and detaching the third strip of adhesive tape.

7. The method of claim 3 further comprising steps of:

after the step of detaching the first strip of adhesive tape, parting the hair with respect to a reference line that extends from a forehead of the head towards a back of the head and is equally distant between ears of the head;

downwardly combing the hair;

attaching a second strip of adhesive tape onto the hair and around a person's neck to thereby form a collar that is substantially parallel to a ground;

cutting the hair along an edge of the second strip of adhesive tape; and detaching the second strip of adhesive tape.

8. The method of claim 7, wherein the first step includes attaching the first strip of adhesive tape onto a first side of a person's chin, the hair and a second side of the chin, the attached strip of adhesive tape extending substantially parallel to a ground.

9. The method of claim 3 further comprising steps of:

after the step of detaching the first strip of adhesive tape, parting the hair with respect to a reference line that extends from a forehead of the head towards a back of the head and is equally distant between ears of the head;

combing the hair on the first side of the head forward and towards a person's face;

attaching a second strip of adhesive tape onto the forwardly combed hair and a first side of a person's neck, the second strip of adhesive tape extending upwardly from the first side of the neck to a first corner where the bangs meet the forwardly combed hair on the first side of the head;

cutting the hair along an edge of the second strip of adhesive tape;

detaching the second strip of adhesive tape;

combing the hair on a second side of the head forward and towards the face;

attaching a third strip of adhesive tape onto the forwardly combed hair and a second side of the neck, the third strip of adhesive tape extending upwardly from the second side of the neck towards a second corner where the bangs meet the forwardly combed hair on the second side of the head;

cutting the hair along an edge of the third strip of adhesive tape;

detaching the third strip of adhesive tape;

downwardly combing the hair on the back of the head;

attaching a fourth strip of adhesive tape onto the hair and a back of the neck, the fourth strip of adhesive tape substantially parallel to a ground;

cutting the hair along an edge of the fourth strip of adhesive tape; and detaching the fourth strip of adhesive tape.

10. The method of claim 9, wherein the step of attaching the fourth strip of adhesive tape includes attaching the fourth strip of adhesive tape onto the hair and a back of a person's body, the third strip of adhesive tape substantially parallel to a ground.

11. The method of claim 3 further comprising steps of:

after the step of detaching the first strip of adhesive tape, parting the hair with respect to a reference line that extends from a forehead of the head towards a back of the head and is equally distant between a first ear and a second ear on the head;

downwardly combing the hair on the first side of the head;

attaching a second strip of adhesive tape onto the hair, the second strip of adhesive tape extending downwardly from a first corner, where the bangs meet the combed hair on the first side of the head, to the back of the head and across the first ear on the first side of the head;

cutting the hair along an edge of the second strip of adhesive tape;

detaching the second strip of adhesive tape;

combing the hair on a second side of the head;

attaching a third strip of adhesive tape onto the hair, the third strip of adhesive tape extending downwardly from a second corner, where the bangs meet the combed hair on the second side of the head, to the back of the head and across the second ear on the second side of the head;

cutting the hair along an edge of the third strip of adhesive tape;

detaching the third strip of adhesive tape;

downwardly combing the hair on the back of the head;

attaching a fourth strip of adhesive tape onto the hair and the neck, the fourth strip of adhesive tape substantially parallel to a ground;

cutting the hair along an edge of the fourth strip of adhesive tape; and detaching the fourth strip of adhesive tape.

12. The method of claim 11, wherein the step of attaching the fourth strip of adhesive tape includes attaching the fourth strip of adhesive onto the hair covering the back of the head, the fourth strip of adhesive tape substantially parallel to the ground.

13. The method of claim 3 further comprising steps of:

after the step of detaching the first strip of adhesive tape, parting the hair with respect to a reference line that extends from a forehead of the head towards a back of the head and is equally distant between a first ear and a second ear of the head;

downwardly combing the hair;

attaching a second strip of adhesive tape onto the hair on the first side of the head, the second strip of adhesive tape extending above the first ear and horizontally from a person's face to the back of the head;

cutting the hair along an edge of the second strip of adhesive tape starting from an end of the second strip on the face and ending at a first location on the head that is behind the first ear with respect to the face;

detaching the second strip of adhesive tape;

combing the hair towards the face, wherein the combed hair is on the first side of the head and is behind the first ear with respect to the face;

attaching a third strip of adhesive tape onto the hair, the third strip of adhesive tape extending upwardly from a middle of a back of a person's neck to the first location;

cutting the hair along an edge of the third strip of adhesive tape;

detaching the third strip of adhesive tape;

attaching a fourth strip of adhesive tape onto the hair on the second side of the head, the fourth strip of adhesive tape extending above the second ear and horizontally from the face to the back of the head;

cutting the hair along an edge of the fourth strip of adhesive tape starting from an end of the fourth strip on the face and ending at a second location on the head that is behind the second ear with respect to the face;

detaching the fourth strip of adhesive tape;

combing the hair towards the face, wherein the combed hair is on the second side of the head and is behind the second ear with respect to the face;

attaching a fifth strip of adhesive tape onto the hair, the fifth strip of adhesive tape extending upwardly from the middle of the back of the neck to the second location;

cutting the hair along an edge of the fifth strip of adhesive tape;

detaching the fifth strip of adhesive tape;

downwardly combing the hair on the back of the head;

attaching a sixth strip of adhesive tape onto the hair covering the back of the neck and onto the neck, the sixth strip of adhesive tape substantially parallel to a ground;

cutting the hair along an edge of the sixth strip of adhesive tape; and detaching the sixth strip of adhesive tape.

14. The method of claim 13, wherein the step of attaching the sixth strip of adhesive tape includes attaching the sixth strip of adhesive tape onto the hair covering the back of the head.

15. The method of claim 2 further comprising steps of:

after the third step, parting the hair with respect to a reference line that extends from a forehead of the head towards a back of the head and is equally distant between ears of the head;

downwardly combing the hair, the combed hair falling on a back of a person's body;

attaching a second strip of adhesive tape onto the hair and the back of the body, the second strip of adhesive tape substantially parallel to a ground;

cutting the hair along an edge of the second strip of adhesive tape; and detaching the second strip of adhesive tape.

16. The method of claim 2 further comprising steps of:

after the third step, parting the hair with respect to a reference line that extends from a forehead of the head towards a back of the head and is equally distant between ears of the head;

downwardly combing the hair;

forming a ponytail behind the head with the hair;

attaching a second strip of adhesive tape onto the ponytail and a person's neck, the second strip of adhesive tape substantially parallel to a ground;

cutting the hair of the ponytail along an edge of the second strip of adhesive tape; and detaching the second strip of adhesive tape.

17. The method of claim 16, wherein the ponytail is a flat ponytail.

18. The method of claim 2 further comprising steps of:

after the third step, parting the hair with respect to a reference line that extends from a forehead of the head towards a back of the head and is equally distant between ears of the head;

downwardly combing the hair;

attaching a second strip of adhesive tape onto the hair, a first side of a person's neck and a back of the head, the second strip of adhesive tape extending upwardly from the first side of the neck to the back of the head;

attaching a third strip of adhesive tape onto the hair, a second side of the neck and the back of the head, the third strip of adhesive tape extending upwardly from the second side of the neck to the back of the head; wherein the third strip and the second strip of adhesive tape meet at the back of the neck;

removing the hair below an edge of the third strip of adhesive tape;

removing the hair below an edge of the second strip of adhesive tape;

detaching the second strip of adhesive tape; and detaching the third strip of adhesive tape.

19. The method of claim 2 further comprising steps of:

after the third step, parting the hair with respect to a reference line that extends from a forehead of a person's head towards a back of the head and is equally distant between ears of the head;

downwardly combing the hair;

attaching a second strip of adhesive tape onto the hair and around a person's neck to thereby form a collar that is substantially parallel to a ground;

cutting the hair along an edge of the second strip of adhesive tape; and detaching the second strip of adhesive tape.

20. The method of claim 19, wherein the first step includes attaching the first strip of adhesive tape onto a first side of a person's chin, the hair and a second side of the chin, the attached strip of adhesive tape extending substantially parallel to a ground.

21. The method of claim 2 further comprising steps of:

after the third step, parting the hair with respect to a reference line that extends from a forehead of the head towards a back of the head and is equally distant between ears of the head;

combing the hair on the first side of the head forward and towards a person's face;

attaching a second strip of adhesive tape onto the forwardly combed hair and a first side of a person's neck, the second strip of adhesive tape extending upwardly from the first side of the neck to a first corner where the bangs meet the forwardly combed hair on the first side of the head;

cutting the hair along an edge of the second strip of adhesive tape;

detaching the second strip of adhesive tape;

combing the hair on a second side of the head forward and towards the face;

attaching a third strip of adhesive tape onto the forwardly combed hair and a second side of the neck, the third strip of adhesive tape extending upwardly from the second side of the neck towards a second corner where the bangs meet the forwardly combed hair on the second side of the head;

cutting the hair along an edge of the third strip of adhesive tape;

detaching the third strip of adhesive tape;

downwardly combing the hair on the back of the head;

attaching a fourth strip of adhesive tape onto the hair and a back of the neck, the fourth strip of adhesive tape substantially parallel to a ground;

cutting the hair along an edge of the fourth strip of adhesive tape; and detaching the fourth strip of adhesive tape.

22. The method of claim 21, wherein the step of attaching the fourth strip of adhesive tape includes attaching the fourth strip of adhesive tape onto the hair and a back of a person's body, the third strip of adhesive tape substantially parallel to a ground.

23. The method of claim 2 further comprising steps of:

after the third step, parting the hair with respect to a reference line that extends from a forehead of the head towards a back of the head and is equally distant between a first ear and a second ear on the head;

downwardly combing the hair on the first side of the head;

attaching a second strip of adhesive tape onto the hair, the second strip of adhesive tape extending downwardly from a first corner, where the bangs meet the combed hair on the first side of the head, to the back of the head and across the first ear on the first side of the head;

cutting the hair along an edge of the second strip of adhesive tape;

detaching the second strip of adhesive tape;

downwardly combing the hair on a second side of the head;

attaching a third strip of adhesive tape onto the hair, the third strip of adhesive tape extending downwardly from a second corner, where the bangs meet the combed hair on the second side of the head, to the back of the head and across the second ear on the second side of the head;

cutting the hair along an edge of the third strip of adhesive tape;

detaching the third strip of adhesive tape;

downwardly combing the hair on the back of the head;

attaching a fourth strip of adhesive tape onto the hair and the neck, the fourth strip of adhesive tape substantially parallel to a ground;

cutting the hair along an edge of the fourth strip of adhesive tape; and detaching the fourth strip of adhesive tape.

24. The method of claim 23, wherein the step of attaching the fourth strip of adhesive tape includes attaching the fourth strip of adhesive onto the hair covering the back of the head, the fourth strip of adhesive tape substantially parallel to the ground.

25. The method of claim 2 further comprising steps of:

after the third step, parting the hair with respect to a reference line that extends from a forehead of the head towards a back of the head and is equally distant between a first ear and a second ear of the head;

downwardly combing the hair;

attaching a second strip of adhesive tape onto the hair on the first side of the head, the second strip of adhesive tape extending above the first ear and horizontally from a person's face to the back of the head;

cutting the hair along an edge of the second strip of adhesive tape starting from an end of the second strip on the face and ending at a first location on the head that is behind the first ear with respect to the face;

detaching the second strip of adhesive tape;

combing the hair towards the face, wherein the combed hair is on the first side of the head and is behind the first ear with respect to the face;

attaching a third strip of adhesive tape onto the hair, the third strip of adhesive tape extending upwardly from a middle of a back of a person's neck to the first location;

cutting the hair along an edge of the third strip of adhesive tape;

detaching the third strip of adhesive tape;

attaching a fourth strip of adhesive tape onto the hair on the second side of the head, the fourth strip of adhesive tape extending above the second ear and horizontally from the face to the back of the head;

cutting the hair along an edge of the fourth strip of adhesive tape starting from an end of the fourth strip on the face and ending at a second location on the head that is behind the second ear with respect to the face;

detaching the fourth strip of adhesive tape;

combing the hair towards the face, wherein the combed hair is on the second side of the head and is behind the second ear with respect to the face;

attaching a fifth strip of adhesive tape onto the hair, the fifth strip of adhesive tape extending upwardly from the middle of the back of the neck to the second location;

cutting the hair along an edge of the fifth strip of adhesive tape;

detaching the fifth strip of adhesive tape;

downwardly combing the hair on the back of the head;

attaching a sixth strip of adhesive tape onto the hair covering the back of the neck and onto the neck, the sixth strip of adhesive tape substantially parallel to a ground;

cutting the hair along an edge of the sixth strip of adhesive tape; and detaching the sixth strip of adhesive tape.

26. The method of claim 25, wherein the attached second strip of adhesive tape extends over the first ear and horizontally from the face to the back of the head and the attached fourth strip of adhesive tape extends over the second ear and horizontally from the face to the back of the head.

27. The method of claim 26, wherein the step of attaching the sixth strip of adhesive tape includes attaching the sixth strip of adhesive tape onto the hair covering the back of the head.

28. The method of claim 25, wherein the step of attaching the sixth strip of adhesive tape includes attaching the sixth strip of adhesive tape onto the hair covering the back of the head.

29. The method of claim 25, wherein the attached second strip of adhesive tape extends over the first ear and horizontally from the face to the back of the head and the attached fourth strip of adhesive tape extends over the second ear and horizontally from the face to the back of the head.

30. The method of claim 29, wherein the step of attaching the sixth strip of adhesive tape includes attaching the sixth strip of adhesive tape onto the hair covering the back of the head.

31. The method of claim 1 further comprising steps of:

before the first step, parting the hair with respect to a reference line that extends from a forehead of a person's head towards a back of the head and is equally distant between ears of the head; and downwardly combing the hair, the combed hair falling on a back of a person's body;

wherein the first step includes attaching the first strip of adhesive tape onto the hair and the back of the body, the first strip of adhesive tape substantially parallel to a ground; and wherein the second step includes cutting the hair along the edge.

32. The method of claim 1 further comprising steps of:

before the first step, parting the hair with respect to a reference line that extends from a forehead of a person's head towards a back of the head and is equally distant between ears of the head;

downwardly combing the hair; and forming a ponytail behind the head with the hair;

wherein the first step includes attaching the first strip of adhesive tape onto the ponytail and a person's neck, the first strip of adhesive tape substantially parallel to a ground; and wherein the second step includes cutting the hair of the ponytail along the edge.

33. The method of claim 32, wherein the ponytail is a flat ponytail.

34. The method of claim 1 further comprising steps of:

before the first step, parting the hair with respect to a reference line that extends from a forehead of a person's head towards a back of the head and is equally distant between ears of the head;

downwardly combing the hair;

wherein the first step includes attaching the first strip of adhesive tape onto the hair, a first side of a person's neck and the back of the head, the first strip of adhesive tape extending upwardly from the first side of the neck to the back of the head;

after the first step, attaching a second strip of adhesive tape onto the hair, a second side of the neck and the back of the head, the second strip of adhesive tape extending upwardly from the second side of the neck to the back of the head;

wherein the first strip and the second strip of adhesive tape meet at the back of the head;

removing the hair below an edge of the second strip of adhesive tape; and detaching the second strip of adhesive tape.

35. The method of claim 1 further comprising steps of:

before the first step, parting the hair with respect to a reference line that extends from a forehead of a person's head towards a back of the head and is equally distant between ears of the head; and downwardly combing the hair;

wherein the first step includes attaching the first strip of adhesive tape onto the hair and around a person's neck to thereby form a collar that is substantially parallel to a ground; and wherein the second step includes cutting the hair along the edge.

36. The method of claim 35, wherein the first step includes attaching the first strip of adhesive tape onto a first side of a person's chin, the hair and a second side of the chin, the attached strip of adhesive tape extending substantially parallel to a ground.

37. The method of claim 1 further comprising steps of:

before the first step, parting the hair with respect to a reference line that extends from a forehead of a person's head towards a back of the head and is equally distant between ears of the head; and downwardly combing the hair;

combing the hair on the first side of the head forward and towards a person's face;

wherein the first step includes attaching the first strip of adhesive tape onto the forwardly combed hair and a first side of a person's neck, the first strip of adhesive tape extending upwardly from the first side of the neck to a first corner where bangs meet the forwardly combed hair on the first side of the head;

combing the hair on a second side of the head forward and towards the face;

attaching a second strip of adhesive tape onto the forwardly combed hair and a second side of the neck, the second strip of adhesive tape extending upwardly from the second side of the neck towards a second corner where the bangs meet the forwardly combed hair on the second side of the head;

cutting the hair along an edge of the second strip of adhesive tape;

detaching the second strip of adhesive tape;

downwardly combing the hair on the back of the head;

attaching a third strip of adhesive tape onto the hair and a back of the neck, the third strip of adhesive tape substantially parallel to a ground;

cutting the hair along an edge of the third strip of adhesive tape; and detaching the third strip of adhesive tape.

38. The method according to claim 37, wherein the step of attaching the fourth strip of adhesive tape includes attaching the fourth strip of adhesive tape onto the hair and a back of a person's body, the third strip of adhesive tape substantially parallel to a ground.

39. The method of claim 1 further comprising steps of:

before the first step, parting the hair with respect to a reference line that extends from a forehead of a person's head towards a back of the head and is equally distant between ears of the head;

downwardly combing the hair; and forming a ponytail on a side of the head, the ponytail extending from the side of the head and substantially parallel to a ground;

wherein the first step includes wrapping the first strip of adhesive tape around the ponytail; and wherein the second step includes cutting the hair of the ponytail along the edge.

40. The method of claim 1 further comprising steps of:

before the first step, parting the hair with respect to a reference line that extends from a forehead of a person's head towards a back of the head and is equally distant between ears of the head;

downwardly combing the hair; and forming a ponytail above the head, the ponytail extending substantially vertically from a top of the head;

wherein the first step includes wrapping the first strip of adhesive tape around the ponytail; and wherein the second step includes cutting the hair of the ponytail along the edge.

41. The method of claim 1 further comprising a step of:

downwardly combing the hair before the first step;

wherein the first step includes attaching the first strip of adhesive tape onto the hair and around a person's head to thereby form a headband.

42. The method of claim 1 further comprising a step of:

dampening the hair before the first step.

43. A method of cutting hair which comprises steps of:

partitioning the hair with a strip of adhesive tape into a first portion of hair and a second portion of hair; and cutting the first portion of hair, wherein the second portion of hair remains attached to a person's head.

* * * * *